US005706878A

United States Patent [19]

Guettler

[11] Patent Number: 5,706,878

[45] Date of Patent: Jan. 13, 1998

[54] SNAP-IN, SNAP-OUT CURTAIN-SUPPORTING UNIT FOR WINDOWS

[76] Inventor: Charles M. Guettler, 3184 Cherokee Rd., St. Cloud, Fla. 34772

[21] Appl. No.: 666,265

[22] Filed: Jun. 20, 1996

Related U.S. Application Data

[63] Continuation-in-part of Ser. No. 300,957, Sep. 6, 1994, abandoned.

[51] Int. Cl.[6] ..... A47H 3/00

[52] U.S. Cl. ..... 160/369; 160/330

[58] Field of Search ..... 160/369, 330, 160/134, 368.1, 405; 403/371, 377

[56] References Cited

U.S. PATENT DOCUMENTS

| | | | |
|---|---|---|---|
| 2,599,222 | 6/1952 | Bergqvist et al. | 403/371 X |
| 3,515,418 | 6/1970 | Nielsen | 403/377 X |
| 4,825,611 | 5/1989 | Bassett | 160/84.01 X |
| 5,044,418 | 9/1991 | Donahue | 160/330 |
| 5,063,985 | 11/1991 | Bozzo | 160/330 |
| 5,159,966 | 11/1992 | Fleishman et al. | 160/330 X |
| 5,219,407 | 6/1993 | Herring | 160/330 |
| 5,295,595 | 3/1994 | Gobidas et al. | 160/330 X |
| 5,407,162 | 4/1995 | Manger | 160/330 X |
| 5,414,950 | 5/1995 | Johnson | 160/372 X |

*Primary Examiner*—David M. Purol
*Attorney, Agent, or Firm*—Julian C. Renfro, Esq.

[57] ABSTRACT

A curtain-supporting unit of a snap-in, snap-out type comprising a plurality of rods interconnected to form a sturdy curtain-receiving framework, with the rods residing essentially in a coplanar relationship. This curtain-receiving framework is adapted to support a curtain and to be installed as an integral curtain-supporting unit on or adjacent the frame of a window. This novel framework is utilized in combination with an array of rod-receiving clips of resilient construction mounted in a spaced, substantially planar relationship adjacent the window frame, with the clip array defining a configuration closely approximating the configuration of the curtain-receiving framework. Each of the clips has an entrance portion of reduced size, enlarging into a portion configured to closely receive and retain a respective portion of a rod of the framework that has been thrust into the clip. Most significantly, this novel curtain-receiving framework is able to be installed in the clip array without occasioning the individual fitting of each respective rod portion onto a particular clip of the clip array. This curtain-receiving framework, when installed in the clip array, forms an arrangement for supporting the curtain in a desired relationship to the window, with the curtain-receiving framework being readily removable from the clips, on occasion, by a relatively simple withdrawal movement.

2 Claims, 4 Drawing Sheets

SNAP-IN, SNAP-OUT CURTAIN-SUPPORTING UNIT FOR WINDOWS

RELATIONSHIP TO EARLIER INVENTION

This invention is a Continuation-in-Part of application entitled "SNAP-IN, SNAP-OUT CURTAIN-SUPPORTING UNIT FOR IRREGULARLY-SHAPED WINDOWS," Ser. No. 08/300,957, filed Sep. 6, 1994, now abandoned.

BACKGROUND OF THE INVENTION

1. Field of the Invention

The present invention relates to hardware for supporting draperies in windows, and more particularly to a sturdy curtain-supporting unit readily installed in arched windows as well as windows of other shapes and sizes.

2. Description of the Prior Art

Through the years a number of homes and buildings have featured curved perimeters, with the arched window being a typical example. Frequently the plans for the interior design of a home or building having such apertures calls for draperies to fill or cover all or part of the apertures. When the portion to be covered is bounded by curved surfaces, such as when the uppermost portion of an arched window is to be covered, standard curtain rods cannot be used.

For many years it was necessary to specially design and manufacture traverse rod assembly to conform to the specific dimensions of the particular architectural aperture in which a drapery was to be installed. In addition to the expense involved in having a unique curtain rod assembly designed and manufactured, errors in manufacturing, damage in transit and/or faulty installation often rendered such a curtain rod assembly unusable or unsightly.

Inexpensive alternatives to specially fabricated curtain rod assemblies have been proposed. Such seemingly economical alternatives have proven to be unacceptable in practice, however. For example, U.S. Pat. No. 2,255,990 issued to P. Stratton discloses a curtain rod bracket assembly which is designed for supporting a standard curtain rod in a curved orientation. The slightest bending of a standard curtain rod will often have the unfortunate effect of causing buckling in one or more places along the rod. Further, even if the rod does not buckle, a uniform curvature is nearly impossible to achieve using a standard curtain rod with the bracket assembly shown in the Stratton patent.

U.S. Pat. Nos. 2,790,558 and 2,890,799 issued to H. Rosenbaum each disclose a flexible traverse rod for conforming to curved window or passageway perimeters. The Rosenbaum traverse rods are shown made of a channel-shaped metallic member with a plurality of slots formed in the intended convex side of the traverse rod. These slots permit the metallic member to be formed into a curved shape with the slots opening at their apex to evenly distribute the deformation along the metallic member and thereby achieve an acceptably uniform curvature.

A serious limitation of the Rosenbaum devices relates to the presence of the slots. The slots formed in the metallic member produce sharp edges and corners which, when coming into contact with the expensive drapery fabric, tends to snag or tear the fabric. This not only damages the fabric, but makes threading the drapery onto the rod very difficult.

The Bassett Pat. No. 4,825,611 entitled "Drapery Rod Assembly For Architectural Apertures" bears some relationship to the instant invention, but it sets forth a number of undesirable features, such as requiring hooks described as "cup hooks" for supporting the upper portion of the drapery assembly 10 that this patentee uses. It is obviously a burdensome task to install Bassett's drapery assembly 10 onto such cup hooks, and quite importantly, the curtains would need to be split to some degree in order to accommodate the cup hooks. Furthermore, the Bassett cup hooks do not hold and support her rod in all directions.

Still further, it is additionally burdensome to require the person endeavoring to install the Bassett device to utilize an arrangement involving the proper setting of the set screw utilized at each joint in the curved upper rod of the drapery assembly. It is to be noted that Bassett specifically requires the drapery or curtain used with her drapery assembly to be made from a circular piece of fabric.

The Donahue Pat. No. 5,044,418 entitled "Window Treatment" contains no article or apparatus Claims, but rather contains method Claims 1 through 16, this being mentioned in the context of pointing out the nature as well as the limitations of the Donahue teaching. The elbow joints of Donahue, best seen in FIG. 2, are not adjustable in any way, and the system as taught by this patentee could not be mass produced because each supporting unit would have to be custom made, amounting to a very costly and time consuming procedure.

Donahue utilizes curtain attachment devices referred to as clips 78 mounted by a screw or nail, with opposing arms of the clip designed to receive the fabric covered, arched, semi-rigid portion of the frame upon which the curtain is mounted. This type of clip is hard for a user to deal with, and Donahue says nothing about her curtain arrangement being of a size and configuration consistent with the placement of her clips, such that her curtain arrangement can be supported in a snap-in, snap-out relationship by the use of such clips.

It was to overcome the disadvantages of these and other such devices that the present invention was evolved.

SUMMARY OF THE INVENTION

The novel curtain-supporting unit of a snap-in, snap-out type in accordance with this invention comprises a plurality of rods interconnected to form a sturdy curtain-receiving framework, with such rods residing in a coplanar relationship. This curtain-receiving framework is adapted to support a curtain of appropriate configuration and to be installed as an integral curtain-supporting unit in the frame of a window. This curtain-receiving framework is utilized in combination with an array of rod-receiving clips of resilient construction, each having an entrance portion. These clips or retaining devices are arrayed in a configuration closely approximating the configuration of the curtain-receiving framework and are mounted adjacent the window frame in a substantially planar array. The instant novel framework, because of its sturdy construction, remains in an essentially consistent size and thus is able to be brought predictably into mating contact with the entrance portion of each of the resilient clips, such that the framework will be maintained in a desired relationship to the window. This advantageous arrangement thus makes it readily possible for the instant curtain-receiving framework to be installed in a snap-in, snap-out relationship with the clips of the clip array, and thus form a highly effective means for supporting the curtain in a desired relationship to the window.

My novel curtain-supporting unit is readily adaptable for installation in windows of a wide variety of sizes and configurations, and quite advantageously, this novel unit or framework is readily removable, on occasion, as an integral unit from the clips on the window frame by a simple withdrawal motion.

My novel curtain-supporting unit being of readily adjustable size, it is easily adapted, even by one previously unfamiliar with the hanging of curtains and drapes, for supporting a curtain or drape in a wide variety of curved or irregularly-shaped windows. Examples of the windows with which my invention may be readily used are one-quarter circle, one-half circle, eyebrow, elliptical, round, hexagonal and octagonal.

A first embodiment of my novel unit comprises a first, substantially straight rod, preferably of telescopic construction, the length of which can be readily adjusted so as to be accommodated in a lower part of the aperture in which the curved window is located. A short, upstanding member is disposed at each end of the first rod, and a second rod, of slightly flexible construction, is usable in an interfitting relationship with the first rod.

The second rod is readily bendable so as to conform to the configuration of the window, which may be a curved window, with the construction of this second rod preferably being such that it maintains the configuration into which it is bent. This second rod has an aperture at each end, such that it can be installed upon the short upstanding members disposed at the ends of the first rod. In this way the first and second rods are disposed in a coplanar relationship. The first and second rods are each of a diameter so as to be receivable in respective prepared edges of the curtain to be mounted upon my novel unit, after which my novel integral curtain unit is readily insertable into the window frame, in which support means are mounted.

The first and second rods thus form a sturdy, highly effective curtain-receiving framework, with the support means utilized in or adjacent the window frame in accordance with this embodiment being configured to enable this curtain-receiving framework to be snapped as an integral unit into position and be securely retained in the window frame. Quite advantageously, the arrangement is such as to permit the integral curtain-supporting unit to be readily removed at such future time as the curtain and/or the associated window is in need of cleaning, with this removal being accomplished by a simple withdrawal motion.

A further feature of my invention involves the fact that the curved upper rod can be cut to a precise length after the integral curtain unit has initially been snapped into place into the array of retaining devices provided around the window frame. This arrangement enables a marketing of my novel integral curtain unit for use in arched windows of a number of different sizes and configuration, with no special skill being required for a custom installation to be accomplished by the typical home owner or do-it-yourselfer.

It is entirely unnecessary to pre-form to a certain configuration, the curtain to be utilized with my novel curtain unit, for the arrangement of adjustable length bottom rod and top rod whose length can be sized during installation of the curtain-receiving framework makes it readily possible to start with curtain material of generally rectangular configuration, and then cause the curtain material to conform in a tasteful manner to the configuration of an arched window. As will become more clear as the description proceeds, it is readily possible for the average home owner or do-it-yourselfer to complete a proper installation of my novel integral curtain unit in an arched window without any professional help being required.

Although I have chosen to describe my invention with reference to an embodiment involving an arched window, it is to be understood that my sturdy curtain-receiving framework may be utilized in a snap-in, snap-out relationship with respect to an array of rod-receiving clips of resilient construction utilized in a wide variety of window sizes and window shapes.

It is a principal object of my invention to provide a curtain-receiving framework of a snap-in, snap-out type that can be utilized in conjunction with a plurality of resilient clips arrayed around a window, with said framework, because of its sturdy construction, being of essentially consistent size and thus able to be brought predictably into mating contact with the entrance portion of each of the resilient clips, without necessitating the individual fitting of each respective rod portion onto a particular clip of the clip array.

It is another object of my invention to provide a curtain-supporting unit of a snap-in, snap-out type that can be utilized as an integral unit for supporting a curtain in a desired relationship to a window, with this sturdy unit being readily removable, on occasion, from a planar array of resilient clips mounted on or adjacent the window frame, by a simple withdrawal motion.

It is still another object of my invention to provide an integral curtain-receiving framework of inexpensive construction designed to maintain its rigidity and integrity such that it may be readily handled as an integral unit by a user, and then snapped into appropriate receptacles or retaining members arranged around the frame of a window, with needed removal of the unit from the window being easily and rapidly accomplished by a simple withdrawal motion at such time as cleaning of the curtain and/or the window is to be accomplished, with no tools being required.

It is yet another object of my invention to provide a curtain-supporting unit of minimal expense, which can be readily fitted to and installed in windows of a wide variety of configurations, without any help from a decorator, interior designer, or other professional being necessary.

It is yet still another object of my invention to provide a curtain-receiving framework involving a bottom rod of adjustable length employed in conjunction with a curved rod whose length can be established during the installation of the curtain unit in a curved window, such that my curtain unit can be utilized in accomplishing a custom installation by a home owner or do-it-yourselfer having no experience in the installation of curtains or drapes in a curved or arched window.

It is a still further object of my invention to provide a sturdy curtain-receiving framework that can be readily conformed to fit in a window of non-standard size, and then snapped into place as an integral unit into resilient mounting means utilized on or adjacent the frame of the window, without any tools being required for the installation, and without requiring any tools or any involved procedure in order to remove the unit at such time as the cleaning of the curtain or the window is desired.

It is yet further object of my invention to provide a curtain-supporting unit that does not require a curtain to be prefitted to the window, inasmuch as my novel unit can be utilized even in curved windows while dealing with curtain material of rectangular configuration.

It is yet further object of my invention to provide a curtain-supporting unit or framework that is designed to accommodate a curtain made out of material such that it can stretch and conform to windows of a wide variety of shapes.

It is a still further object of my invention to provide a novel method for installing a curtain-supporting unit of readily adjustable size in the frame of a curved window, involving minimal skill requirements and no involved tooling, which unit can thereafter be readily removed for the cleaning of the curtain or the window.

These and other objects, features and advantages will become more apparent as the description proceeds.

DETAILED DESCRIPTION

Figure 1:
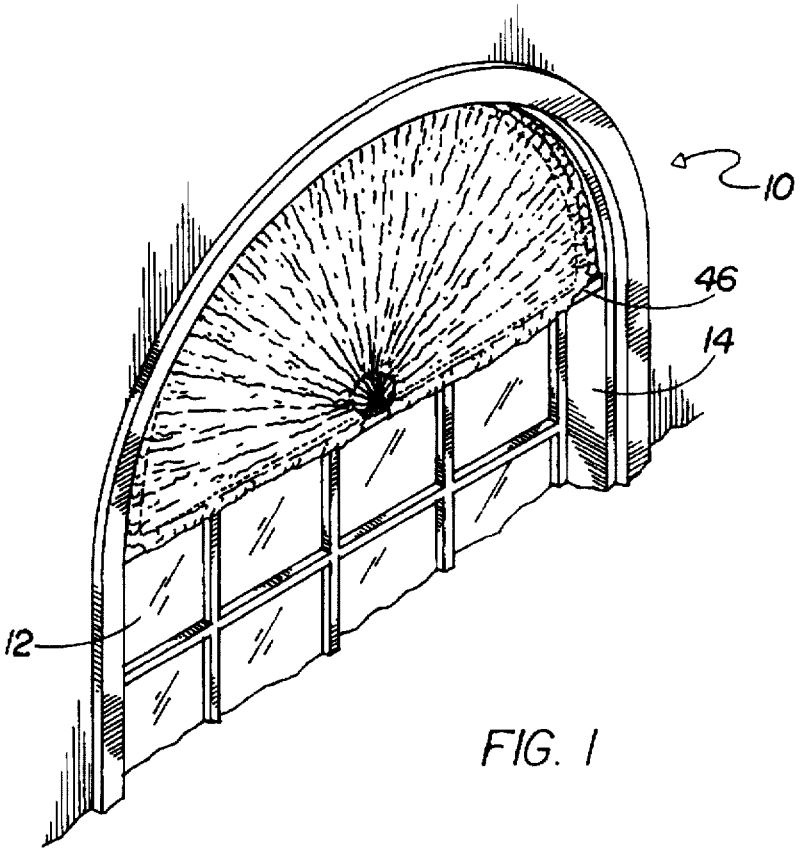
FIG. 1 is a perspective view of an arched window utilizing my novel curtain-supporting unit.

With initial reference to FIG. 1 it will be seen that I have illustrated a curtain-supporting unit 10 in accordance with this invention, which is shown in its installed position in window 12, which in this instance is an arched window. A curved frame 14 is disposed in surrounding relationship around the window 12, with a portion of the window frame 14 serving to support both the bottom as well as the upper portion of the curtain-supporting unit 10. As will be described at length hereinafter, my novel curtain-supporting unit or curtain-supporting framework 10 is of readily adjustable size, such that it can effectively support a curtain or drape in curved or irregularly-shaped windows of many different sizes and configuration.

In each instance, my integral curtain-supporting unit is of snap-in, snap-out construction, comprising a plurality of rods interconnected to form a sturdy curtain-receiving framework readily received in a substantially planar array of resilient clips, with this arrangement being found by the average home owner to be highly advantageous. In other words, after the installation of a curtain thereon, my novel curtain-supporting unit can be readily snapped into engagement with an array of resilient clips mounted adjacent the window, with each clip oriented to receive the unit. The unit can later be quickly removed from the window by a simple withdrawal motion at such time as cleaning of the curtain and/or the window is to be accomplished, followed by the reinsertion of the unit into the desired relationship with the clip array.

Figure 2:
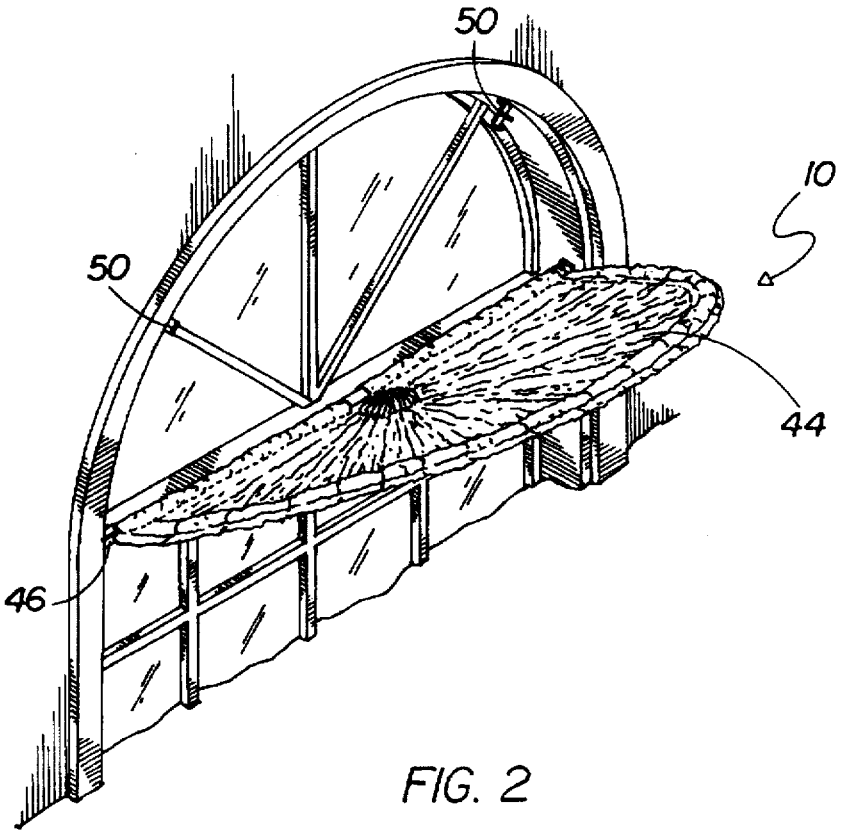
FIG. 2 is a perspective view closely resembling FIG. 1 but showing how my integral curtain-supporting unit may be readily moved away from contact with the upper portion of the arched window.

In FIG. 2 I reveal my novel curtain-supporting unit 10 in a position tilted outwardly from the Window frame 14 in order to reveal a curtain 44 stretched upon my novel integral curtain-supporting unit, with the lower portion of the curtain-supporting unit being supported from means located on and attached to the left and rights sides of the window frame.

Figure 3:
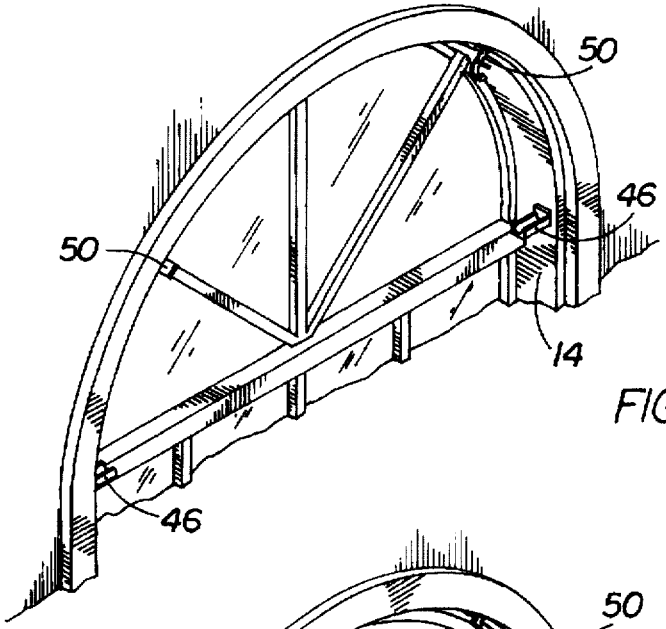
FIG. 3 is a view of the arched window with the curtain unit entirely removed, thus to reveal some of the mounting means with which my curtain unit is operatively associated.

In FIG. 3 I reveal that these support means preferably take the form of components 46 secured to the left and right sides of the window frame 14. I prefer to refer to these components as base members or bottom rod support devices, with the devices 46 being shown to a larger scale in FIG. 8. The design of the devices 46 is such that the lower portion of this embodiment of my curtain-supporting unit merely rests in the components 46. A standoff 48 is utilized in each device or member 46 for a purpose described hereinafter, and the devices 46 can be installed with but the use of a single screw, thus minimizing any marring or scarring of the window frame 14. The devices 46 are usually installed in a relatively low portion of the curved part of the window, with the device 46 on the left side of the window frame typically residing in a horizontal relationship to the comparable device mounted on the right side of the window.

Figure 4:
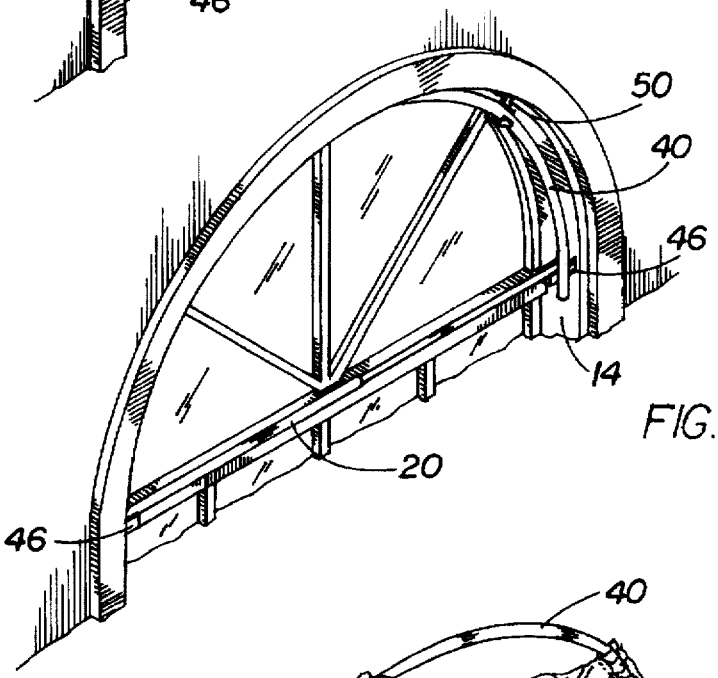
FIG. 4 is a view similar to FIG. 3, but showing a curved rod of the type utilized in conjunction with my curtain-supporting unit, this rod being held in place by resilient clips mounted in a coplanar array on the window frame.

As will shortly be discussed, in accordance with a preferred embodiment of my invention, a straight rod 20 is utilized in combination with a curved rod 40, also referred to as the second rod, which defines the upper contour of the curtain-receiving framework or unit. In FIG. 4 I illustrate the manner in which such a curved rod is supported by a series of resilient clips or rod retaining devices 50 installed in a substantially planar relationship in the curved upper portion of the window, with each clip of the clip array having an entrance portion into which a rod of the curtain-receiving framework can be readily inserted.

Figure 5:
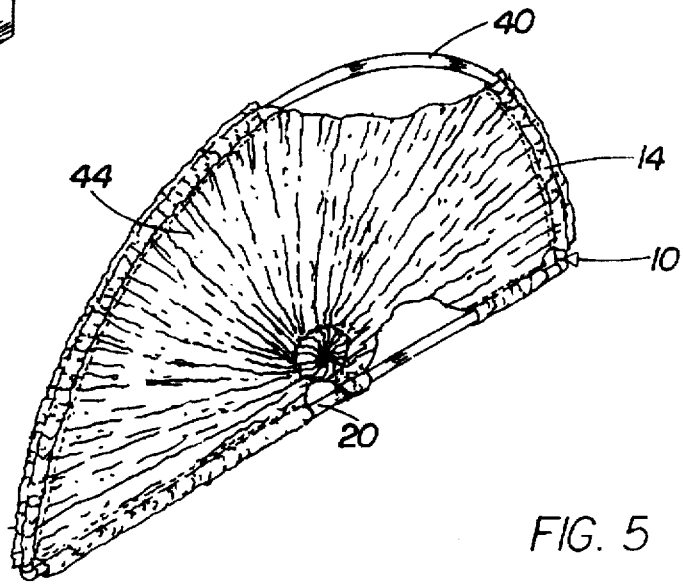
FIG. 5 is a view of my novel curtain-receiving framework entirely removed from the frame of the window, with portions of the curtain cut away to reveal the manner in which the curtain is received on the novel framework.

In FIG. 5 I illustrate one embodiment of my novel curtain-supporting unit 10 that has been removed from the respective window, with this figure revealing that a lower portion of the unit 10 is defined by a substantially straight rod 20. The ends of the rod 20 are interconnected with the ends of a second rod 40, with the rod 40 in this instance being of curved configuration. The rod 20 will from time to time be referred to as the first rod or the bottom rod, and as will shortly be described, in accordance with a preferred embodiment of this invention, the length of the rod 20 can be readily adjusted so that the curtain-supporting rod can be closely received in the particular window frame in which the curved window is located.

It is to be emphasized that in the embodiment illustrated in FIGS. 3 through 5, the clip members 50 are all in the same plane as the bottom rod support devices 46 designed to receive the bottom rod 20. The second or curved rod 40 serves as the support for the upper portion of the window unit. As is apparent, my curtain-supporting unit or framework may be regarded as residing in a substantially flat plane.

Figure 6:
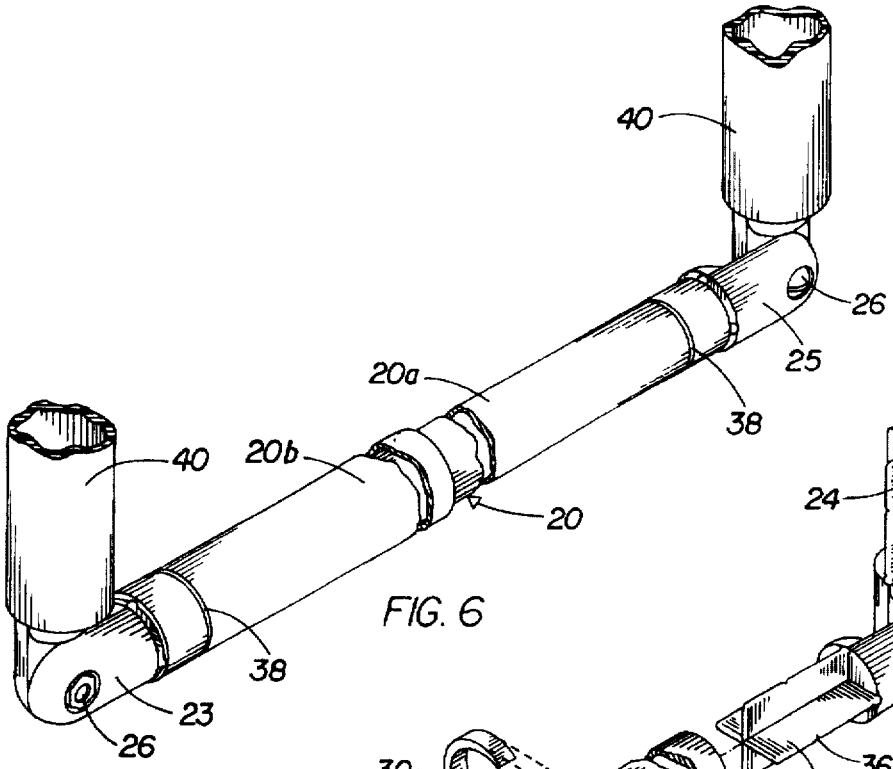
FIG. 6 is a view to a somewhat larger scale of the type of construction that may be utilized as the bottom rod of one embodiment of my novel curtain unit, with this construction making it possible for the user to readily select the effective length of the bottom rod.
Figure 7:
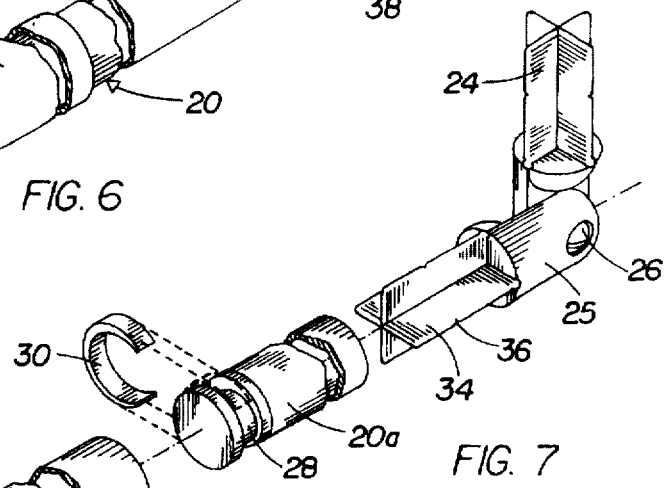
FIG. 7 is a view along the lines of FIG. 6, but with certain components of the bottom rod cut away and separated so as to reveal the specific mounting arrangement and the specific locking arrangement I prefer for the bottom rod.

In FIGS. 6 and 7, described hereinafter, I reveal a specific arrangement by which the effective length of the first or bottom rod 20 can be readily changed, and then fixed in that position.

Figure 13:
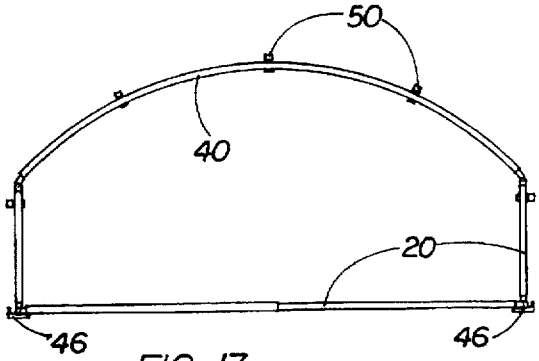
FIG. 13 is a view illustrating the fact that a sturdy curtain-receiving framework in accordance with this invention can be configured into an integral curtain-supporting unit able to support a comparatively large curtain in a curved window, with this curtain-receiving framework received in a snap-in, snap-out relationship to an array of rod-receiving clips of resilient construction mounted adjacent the window frame.
Figure 14:
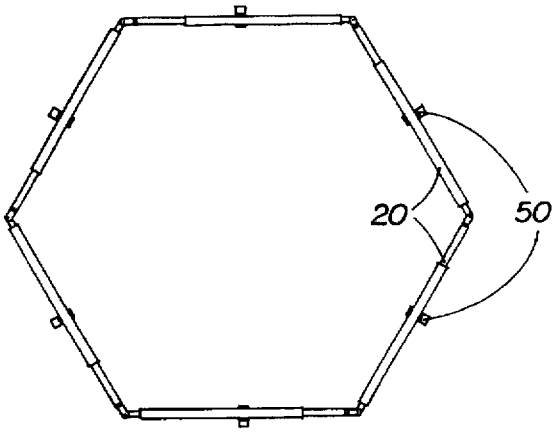
FIG. 14 is a view illustrating that a sturdy curtain-receiving framework in accordance with this invention can be of hexagonal shape, with no curved member being involved.
Figure 15:
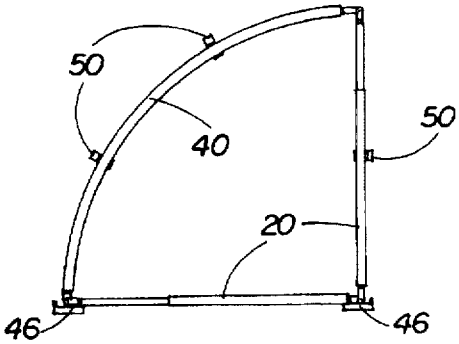
FIG. 15 is a view revealing that a curtain-receiving framework in accordance with this invention may be utilized with a quarter-round window, being held in place by a plurality of clips of resilient construction.

In FIGS. 13 through 15, discussed hereinafter, I show instances in which a sturdy curtain-supporting framework in accordance with my invention can take various configurations.

In the embodiment of my invention illustrated in FIG. 5, the straight rod 20 is utilized in combination with the aforementioned curved rod 40, also referred to as the second rod, which defines the upper contour of the integral curtain-supporting unit. The rod 40 is of relatively flexible material, and is to be cut to length during the time of initial installation of this embodiment of my novel curtain-supporting unit 10 in a selected window. The rod 40 may be made of flexible tubing, such as low density plastic polypropylene, and by having a sidewall thickness on the order of ⅛ inch, any kinking of the rod or tube is quite unlikely. This material tends to remain in the approximate position into which it is bent. As will be discussed hereinafter with respect to FIG. 9, the rod 40 is held in place by an array of rod-receiving clips 50 of resilient construction, which clips are oriented to receive the rod in what may be regarded as a snap-in relationship. The resilient clips 50 form an important aspect of my invention.

Figure 8:
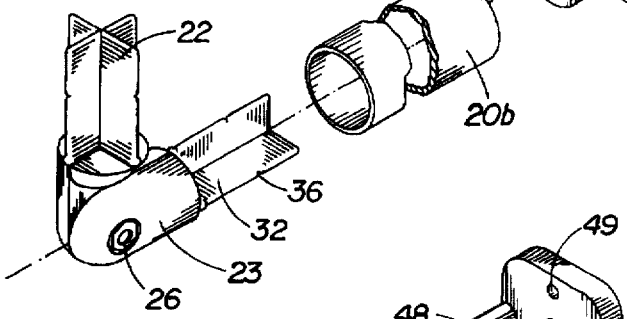
FIG. 8 is a view to a comparatively large size of the supporting devices utilized for supporting the bottom rod of my novel curtain unit in the frame of window.
Figure 8:
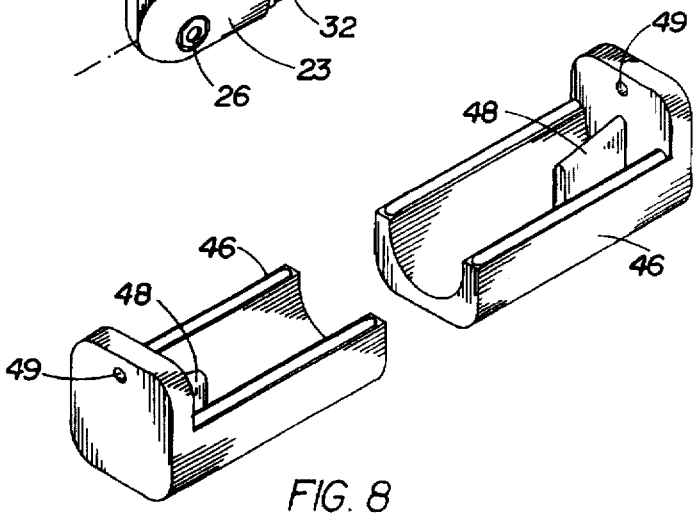

Continuing with the embodiment depicted in FIG. 5, in accordance with the preferred installation procedure, the bottom rod support devices 46 depicted to some extent in FIGS. 3 and 4, and shown more clearly in FIG. 8, are installed in the frame 14 of the window. As earlier mentioned, the devices 46 are typically secured in a horizontal relationship so that the bottom rod 20 received therein will be parallel to the floor of the room.

Turning now to FIG. 6, it will be seen that I have shown that the bottom rod 20 of the curtain-receiving framework may be of telescopic construction. In the illustrated instance, the bottom rod is of a foreshortened configuration, with fragmentary portions of the curved rod 40 shown at the ends of the rod 20. The curved rod 40, shown only in fragmentary form in FIG. 6, is preferably of tubular construction, but in some instances appropriate holes could be placed in the ends of a rod 40 that is not of tubular construction, so as to enable installation of this rod onto the end members of the straight or bottom rod 20.

With reference to FIG. 7, it is to be seen that the ends of the second rod 40 are supported by short upstanding end members 22 and 24 affixed to the ends of the bottom or first rod 20. The end members 22 and 24 are usually on the order of two to three inches long, but I am not to be limited to this. It will be noted that the end member 22 is supported from elbow-shaped member 23 by a nut and bolt combination 26. Similarly, end member 24 is supported from elbow-shaped member 25, also by the use of a nut and bolt combination 26. As a result of this arrangement, each of the upstanding end members can be secured in a specific angular relationship to the first rod 20, which angle is of course selected by the user in accordance with the specific window configuration being dealt with.

It is most important to note that in accordance with one of the key features of this invention, these end members or components 22 and 24 can be moved to any of a wide variety of angular relationships with respect to the straight portion of the bottom rod 20, thus to enable windows of a wide variety of configurations to be accommodated. The members 22 and 24 may be moved into angular positions of less than or greater than 90°, and by way of example, in the instance of the hexagonal window illustrated in FIG. 14, the components or end members 22 and 24 would be moved into angular relationships of 120°.

Continuing with FIG. 7, it will be noted that the inner end 32 of the elbow member 23, and the inner end 34 of the elbow member 25 are preferably of "X" or cruciform configuration, with notches 36 disposed in aligned relationship on all four components or legs of each of the members 32 and 34. These notches 36 are provided for a particular reason, namely, so that after the members 32 and 34 have been installed in respective ends of the rod 20, an encircling groove or indentation 38 can be created in each end of the member 20, in alignment with the notches 36. These grooves or indentations 38 are illustrated in FIG. 6, and this arrangement serves to secure the members 32 and 34 in the ends of the bottom rod 20 while still permitting relative rotation of these members with respect to the rod.

It is to be understood that the second rod 40 is of slightly flexible construction, being utilized in the previously-described interfitting, coplanar relationship to the first rod 20. The rod 40 is readily bendable so as to conform to the configuration of the curved window, yet it has sufficient structural integrity to tend to maintain the desired configuration into which it is bent. I prefer to utilize low density polypropylene as the material out of which the second rod 40 is constructed, although I am not to be restricted to the use of only this material. I have been particularly pleased with the results obtained by the use of low density polypropylene tubing having a 1 inch outside diameter, a ¾ inch inside diameter, therefore having a wall thickness of ⅛ inch, but it is not a requirement of this invention to use tubing of this size.

The second rod 40 has an aperture at each end, such that it can be installed upon the aforementioned upstanding members 22 and 24 disposed at the ends of the first rod 20. In the event the rod 40 is of tubular construction, the inner diameter is such that the ends of the rod 40 fit closely upon the members 22 and 24, with the pair of rods thus residing in a sturdy coplanar relationship. The first rod 20 and the second rod 40 are each of a diameter so as to be receivable in respective tubularly-shaped apertures created along the edges of the curtain 44 to be mounted upon the curtain-supporting unit 10, in the manner depicted in FIG. 5. I prefer to call these edges of the curtain "prepared" edges.

As will be described at some length hereinafter, during the installation of a curtain on my novel curtain-supporting unit, after a first end of the flexible rod 40 has been inserted upon a first of the upstanding members on the first rod 20, the second or final end of the rod 40 is inserted through the prepared edge of the curtain immediately prior to the aperture on the second end of the rod 40 being inserted upon the remaining upstanding member of the first rod 20.

It is possible for the bottom rod 20 to be of fixed length, in the event it is manufactured for installation in an arched window of standardized size. In most instances, however, I have found it advantageous to market my novel curtain-receiving framework with a bottom rod 20 whose length can be readily adjusted, with the length of the curved rod 40 used therewith being able to be cut to the appropriate length.

Considering bottom rods of adjustable length, it is to be borne in mind that I am not to be limited to any one arrangement enabling the effective length of the first or bottom rod 20 to be readily changed, and then fixed in that position. I am aware that screwed-together rods are on the market, whose overall effective length is determined by the extent that one rod is rotated relative to the other. However, I have found the arrangement depicted in FIG. 7 to be particularly satisfactory, and in this instance the first or bottom rod comprises two distinct components, with component or portion 20*a* being of a slightly smaller diameter than the component or portion 20*b*. The particular relationship is such that the exterior diameter of the unit or portion 20*a* fits relatively closely inside the interior of rod unit or portion 20*b*. Located relatively close to the end of rod portion 20*a* is a circumferentially disposed notch in which an eccentric member 28 is disposed. Utilized in concert with the eccentric member 28 is a "C" shaped member or clip 30, which is of a width or left-right dimension to fit into the notch in which the eccentric member 28 is disposed. The clip member 30 is normally of a slightly larger diameter than the interior of the rod portion 20*b*, so after the clip member 30 has been installed adjacent the eccentric member 28, its diameter must be compressed somewhat in order that it can be inserted into the interior of the rod portion 20*b*.

As will be understood by those skilled in this art, when the C-shaped member 30 is in one rotational orientation with respect to the eccentric member 28, the smaller rod portion 20*a* can be moved without too much difficulty along the length of the interior of the larger rod portion 20*b*. However, upon the user twisting one component or rod portion with respect to the other, this causes the eccentric member 28 to rotate with respect to the clip 30 which, because of its diameter, tends to stay in one rotational position inside the larger rod portion 20*b*. Because of the relative motion of the eccentric member with respect to the clip 30 at the time of the twisting of the components 20*a* and 20*b*, a form of locking relationship is brought about. When the user has twisted one portion or component of rod 20 into quite firm engagement with the other portion or component of the rod 20, a highly effective locking arrangement is achieved, and the first or bottom rod 20 can be expected to effectively maintain this selected length throughout the curtain installation procedure.

With continuing reference to FIG. 7, it is obvious that the diameter of member 32, attached to the elbow 23, must be slightly larger than the diameter of member 34, which is attached to the elbow 25, so that member 32 will make firm contact with the interior of the somewhat larger rod portion 20*b*, and so that member 34 will make firm contact with the interior of the slightly smaller rod portion 20*a*.

It has previously been mentioned that I use bottom rod support devices 46 on opposite sides of the arched window, and these devices, depicted in FIG. 8, are of a size to receive the elbow devices 23 and 25 in a relatively tight fitting relationship. I provide a screw-receiving hole 49 in the end of each support device 46, so that the user can firmly secure both devices 46 to the frame 14 surrounding the window 12, typically at a comparatively low portion of the curved or arched portion of the window. Because of the previously-mentioned standoff 48 that is utilized in each rod support device 46, the elbows or elbow devices 23 and 25 forming the left and right ends of the bottom rod 20 are prevented from closely approaching the curved frame 14 of the arched window 12. This arrangement is advantageous because in some instances, a ruffled overhang may be provided on the curtain 44, and the utilization of the standoffs prevents, as mentioned hereinabove, the curved rod 40 from being spaced so close to the curved window frame 14 as not to accommodate the ruffled overhang that may be utilized around the periphery of the curved upper portion of the curtain unit.

Figure 9:
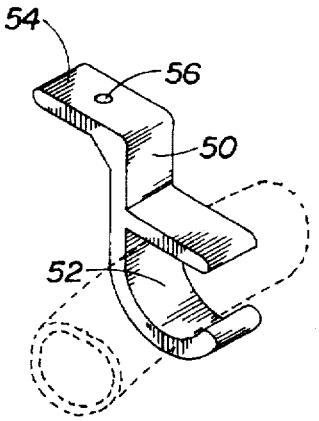
FIG. 9 is a perspective view of a typical rod-retaining device or resilient clip of the type I prefer to utilize for enabling my novel curtain-receiving framework to be snapped into place adjacent a window frame of selected configuration.

It has previously been mentioned that I utilize means for removably securing the curved rod 40 of the curtain-receiving framework to the upper or arched portion of the window frame 14, and in accordance with this invention, I prefer to employ a plurality of the previously mentioned rod-retaining devices or clips 50 of the type illustrated in detail in FIG. 9. It was previously pointed out that these rod-retaining devices 50 are of resilient construction, and each clip or device 50 has a rod-receiving portion 52. However, in order for the rod 40 to reach the rod-receiving portion 52 of a given clip, it must pass through an entrance portion of reduced size. As will be apparent from FIG. 9, the reduced size portion enlarges into the rod-receiving portion that is configured to closely receive and retain a respective portion of a rod of the curtain-receiving framework.

Each clip member 50 may be regarded as generally of "C" shape configuration, with it to be understood that the entrance portion of this member is somewhat smaller than the diameter of the curved rod 40 after the curtain 44 has been installed thereon. Because each clip member is of resilient construction, the rod-receiving portion 52 substantially returns to its original form or position after the insertion of the curtain-containing upper rod 40 into the portion 52, thus to effectively retain the rod 40.

With regard to the orientation of the resilient clips, it is important to note that the several rod-receiving clips 50 of the clip array are installed on or adjacent the window frame such that the rod-receiving entrance portion of each clip is directed outwardly, so as to be able to readily permit the entry of the curtain-receiving framework.

As a result of this arrangement, upon the curved rod 40 of my novel curtain-supporting unit being pushed into contact with the entrance portion of each of the rod retaining devices 50 mounted on or adjacent the window frame 14, the entrance portion of each device 50 flexes to a sufficient extent as to admit and then tightly retain that particular portion of the curved rod 40. In other words, the installation of my resilient rod-retaining devices 50 in a common plane on the window frame enables my novel curtain-receiving framework to be snapped in a highly advantageous manner into place in the window frame. The framework can thereafter be easily removed by a simple withdrawal motion at such time as the curtain and/or the window is in need of cleaning or replacement, and then, after cleaning, readily reinstalled.

It will be noted from FIG. 9 that each rod-retaining device or clip 50 may have a flat mounting portion 54 that is adapted to be brought into close engagement with the interior portion of the window frame 14 at a location such as shown in FIGS. 2 and 3. At least one hole 56 is provided in the flat portion 54 of each clip, so as to permit a screw to be inserted and then used for securing the rod-retaining device in the selected position. Depending on the size of the particular window involved, I may use two, three, four or more of the rod-retaining devices or clips 50 at spaced locations along the curved frame 14, in order that the upper portion of my novel curtain-receiving framework may be snapped into place, and then retained in the desired relationship depicted in FIG. 1. As is obvious, removal of the upper rod from the clips or rod-retaining devices 50 can be readily accomplished with a pull on the upper rod that need not be particularly forceful. After that, the curtain-supporting unit can be easily lifted out of the support devices 46 in which the bottom rod 20 normally rests.

Considering now in further detail, the manner in which a user would typically go about installing my novel integral curtain-supporting unit in a window, support devices 46 are typically utilized when a curtain is to be installed in a window of the configuration illustrated in FIGS. 1 through 5. After the devices 46 have been mounted in alignment on opposite sides of the window frame 14, the bottom rod 20 is then adjusted to the appropriate length, such that the extreme ends of the rod 20 are in contact with the standoff 48 located in each support device 46. It has already been mentioned that the standoff 48, in combination with the spacing of the C-shaped portion 52 of the rod-retaining devices 50, enables the flexible rod 40 to be spaced from the framework of the window a sufficient distance as to permit a ruffled edge or the like to exist around the periphery of the curtain.

Continuing with the installation procedure, the person installing the curtain-receiving framework inserts one end of the flexible rod 40 on one of the upstanding members attached to the bottom rod 20. He or she then inserts the upper rod 40 onto the "C" shaped portion 52 of the first rod retaining device 50. He or she then works upwardly from that location, snapping the flexible rod into the C-shaped portion 52 of each of the remaining rod-retaining devices 50 until the flexible rod 40 is brought around to the opposite end of the bottom rod 20. The person installing this novel unit then carefully marks the flexible rod 40 such that the length of the rod will be able to be inserted upon the other upstanding member attached to the bottom rod 20. At this point the flexible rod 40 can be cut to the proper length, and the end of the rod inserted upon the remaining upstanding member attached to the bottom rod 20. The properly sized rod 40 is then removed, and both rods inserted into the curtain, in accordance with the procedure illustrated in FIGS. 10 through 12, to be described shortly.

As an alternative to the foregoing procedure, the user can size the lower rod and the upper rod with the curtain being in place, which will of course make it unnecessary to remove the rods 20 and 40 from their respective support devices after the sizing procedure has been completed. However, this is not usually the preferred procedure.

It is most important to note that after a curtain-receiving framework has been sized to a given window, it can be installed and removed a number of times from that window with a minimum of effort. This novel framework, because of its sturdy construction, remains of an essentially consistent size and thus is able to be brought predictably into mating contact with the entrance portion of each of the resilient clips, without occasioning the individual fitting of each respective rod portion onto a particular clip of the clip array. It is because of this significant feature that I refer to my curtain-supporting unit as being of a snap-in, snap-out type.

Figure 10:
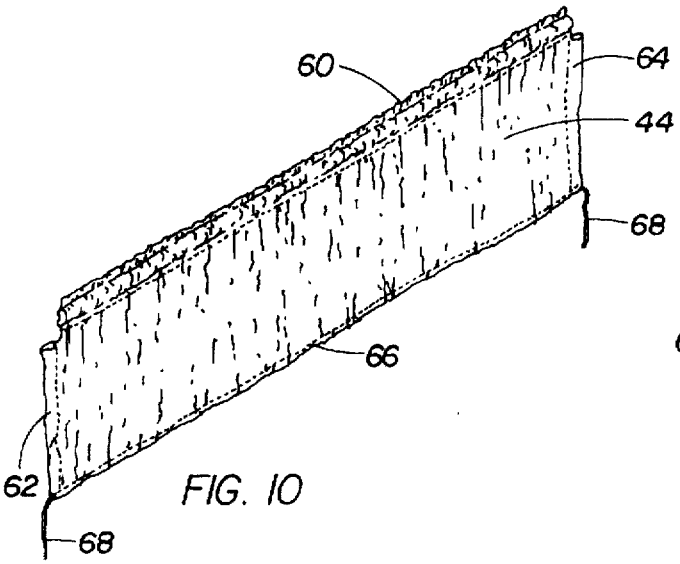
FIG. 10 illustrates the type of curtain usable with my novel curtain-supporting unit, which curtain may, for example, be initially of generally rectangular configuration, but nevertheless effectively usable in a curved window.

Another of the advantageous features of my invention involves the fact that it does not require that the curtain be preshaped into the curved configuration of the window. As shown in FIG. 10, I can utilize a curtain 44 that is basically of rectangular configuration, along certain edges of which a casing or rod-receiving portion is created by running a pair of seams a spaced distance apart. It will be recalled that I prefer to call these the "prepared" edges of the curtain. In FIG. 10 it will be seen that the prepared upper edge 60 extends the full length of the rectangularly-shaped curtain 44, with ends 62 and 64 each having a prepared edge.

Although such is not a firm requirement, I prefer to utilize curtain material that has elastic qualities, such that it can be stretched to whatever extent is necessary during the installation procedure. This type of curtain material is known as Lycra stretch fabric, which is available through Native Textiles as well as other manufacturers.

Figure 11:
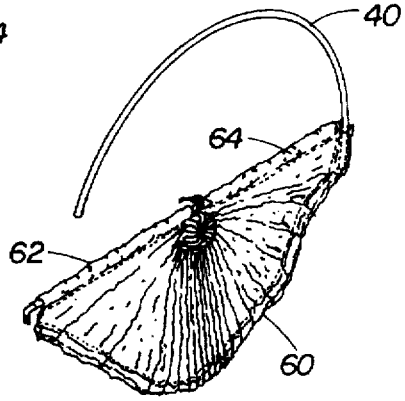
FIG. 11 is a perspective view of a curtain of the type discussed in conjunction with FIGS. 1 through 5, into which the curved rod has not yet been inserted.

At this point the user brings the edges 62 and 64 of the curtain 44 into general alignment, as indicated in FIG. 11, after which he or she installs the straight bottom rod 20 through the prepared edges 62 and 64. This causes the long edge 60 of the curtain 44 to assume a generally circular configuration, and the edge 66 opposite the edge 60 to be bunched up. As shown in FIG. 10, a drawstring 68 may be utilized along the edge 66, so that the edge 66 can be made desirably tight.

Figure 12:
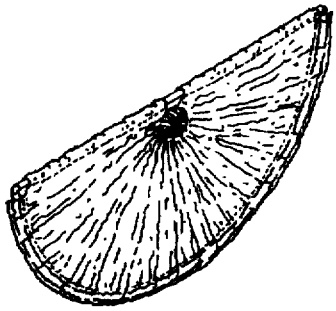
FIG. 12 is a view of the curtain unit of FIG. 11 after installation of the straight and curved rods is largely complete.

From comparing FIG. 11 with FIG. 12, it can be seen that upon the curved rod 40 being inserted through the prepared top edge 60 of the curtain 44, the curtain 44 is caused to attain a desirable configuration such that upon the bottom rod being placed in the support devices 46 mounted in the window frame, the upper portion of the curtain unit can be readily installed upon the substantially planar array of rod-retaining devices 50, in the manner described hereinabove. It has been previously mentioned that the pair of support devices 46 and the rod-retaining devices 50 should be mounted on the window frame 14 in a coplanar relationship, so that upon my novel integral curtain-receiving framework 10 being snapped into place, it will reside in a desirably flat configuration.

Although I have shown my novel curtain unit or framework 10 installed in a window that forms a semi-circle, I am aware that some curved windows are, in a manner of speaking, of elongate configuration, with the height of the arched window being relatively small, and the width of the window being relatively large. In other words, these windows possess less curvature than a window that forms a semi-circle, with some calling these mission-style windows. As is obvious, my invention can be utilized in conjunction with this latter form of window in essentially the same manner as it is used in a semi-circular arched window of the illustrated type.

With reference to FIG. 13, it will be seen that my novel curtain-receiving framework can be utilized with a type of curved or arched window different from that shown in FIGS. 1 through 4. In FIG. 13, it will be seen that the bottom rod 20 may be of the type depicted in FIGS. 6 and 7, wherein the effective length of the rod can be readily established by sliding the components apart for an appropriate extent, and then twisting one component with respect to the other to achieve locking. The rods on each end of the framework depicted in FIG. 13 may, for example, be of fixed length, and secured to the bottom rod by the use of elbows of the type illustrated in FIGS. 6 and 7. The upper rod 40 is of course of flexible construction being held in the desired relationship to the curved or arched window by the utilization of an appropriate number of the resilient devices 50 disposed in a substantially planar array.

In FIG. 14 it is to be seen that a hexagonally-shaped curtain-receiving framework can be created by six rods, each of an extensible type, but as is obvious, the rods can be of fixed length if the particular hexagonally-shaped window with which this framework is to be used is of standardized size. In each instance, an elbow 23 is utilized at one end of a given rod, where it joins one adjacent rod, whereas an elbow 25 is utilized at the other end of the given rod, where it joins the other adjacent rod, that is, the rod at the other end of the given rod. As previously mentioned, the elbow members are each set in this instance at an angle of approximately 120°. It is obvious, in this particular embodiment of my invention, that no flexible rod is involved, and a series of rod-receiving clips of resilient construction are utilized for supporting the framework.

With reference to FIG. 15, it is to be seen that my novel curtain-receiving framework may be adapted for installation in a quarter-round window. In this instance, adjacent extensible rods 20 disposed in a right angle relationship are joined by an elbow of appropriate size, with the opposite ends of these rods being joined to opposite ends of a curved rod 40 by the use of additional elbows. As is obvious, a pair of support devices 46 are utilized for supporting the horizontally-disposed rod 20, whereas one, two or more of the resilient clips 50 are employed for supporting the vertically-disposed rod in the desired relationship to the window. Two or more resilient clips 50 are utilized for supporting the curved rod 40 around the upper portion of the window.

It should now be apparent that I have provided a number of highly effective curtain-supporting arrangements, enabling a curtain or drape to be mounted in a wide variety of curved or irregularly-shaped windows, with these curtain-supporting units being snapped into place into or adjacent the window frame, easily removed from the window frame at the time cleaning is needed, after which the curtain-supporting unit can be readily reinstalled.

It is important to understand that a highly effective curtain-supporting unit of a snap-in, snap-out type has been provided, comprising a plurality of rods interconnected to form a sturdy curtain-receiving framework, with the rods residing essentially in a coplanar relationship. My novel curtain-receiving framework, because of its sturdy construction, is of essentially consistent size and thus is able to be brought predictably into mating contact with the entrance portion of each of the resilient clips, without necessitating the individual fitting of each respective rod portion onto a particular clip of the clip array.

It should now be clear that my novel curtain-receiving framework is utilized in combination with an array of rod-receiving clips of resilient construction mounted in a spaced, substantially planar relationship on a window frame, with the clip array defining a configuration closely approximating the configuration of the curtain-receiving framework.

Each of the clips has an entrance portion of reduced size, enlarging into a portion configured to closely receive and retain a respective portion of a curtain rod of the framework that has been thrust into the clip. Quite advantageously, the curtain-receiving framework is installed in the clip array without occasioning the individual fitting of each respective rod portion onto a particular clip of the clip array.

The curtain-receiving framework, when installed in the clip array, forms a means for supporting the curtain in a desired relationship to the window, with the curtain-receiving framework being readily removable from the clips, on occasion, by a relatively simple withdrawal movement.

As is obvious, I am not to be limited to any one configuration or arrangement except as required by the scope of the appended claims.

I claim:

1. A curtain-supporting unit of a snap-in, snap-out type comprising a plurality of rods interconnected to form a sturdy curtain-receiving framework, with said rods residing essentially in a coplanar relationship, said curtain-receiving framework adapted to support a curtain and to be installed as an integral curtain-supporting unit adjacent the frame of a window, said curtain-receiving framework utilized in combination with an array of rod-receiving clips of resilient construction mounted in a spaced, substantially planar relationship adjacent a window frame, said clip array defining a configuration closely approximating the size and configuration of said curtain-receiving framework, each of said resilient clips of said array being generally of C-shaped configuration and having an outwardly directed entrance portion of reduced size, enlarging into a portion configured to closely receive and retain a respective portion of a rod of said framework that has been thrust into the clip, said framework, because of its sturdy construction, being of essentially consistent size and thus able to be brought predictably into mating contact with said outwardly directed entrance portion of each of said resilient clips, without occasioning the individual fitting of each respective rod portion onto a particular clip of said clip array, said framework, when installed in said clip array, forming an effective means for supporting the curtain in a desired relationship to the window, said curtain-receiving framework being readily removable from said clips, on occasion, by a relatively simple withdrawal movement, said curtain-receiving framework comprising a first rod to be installed in the frame of the window, a short, upstanding member operatively disposed at each end of said first rod, and a second rod usable in an interfitting relationship with said first rod, said second rod having an aperture at least at one end, such that said aperture in said second rod can be installed upon one of said upstanding members disposed at the ends of said first rod, said first rod and said second rod each being of a diameter so as to be receivable in respective prepared edges of a curtain to be mounted upon said curtain-receiving framework, said rods being received in the prepared edges of the curtain immediately prior to the apertures of said second rod being inserted upon said upstanding members of said first rod, each of said short, upstanding members operatively disposed at the ends of said first rod being adjustably held by mechanical fastening means in a selected angular relationship to said first rod.

2. A curtain-supporting unit of a snap-in, snap-out type comprising a plurality of rods interconnected to form a sturdy curtain-receiving framework, with said rods residing essentially in a coplanar relationship, said curtain-receiving framework adapted to support a curtain and to be installed as an integral curtain-supporting unit in the frame of a window, said curtain-receiving framework utilized in combination with an array of rod-receiving clips of resilient construction mounted in a spaced, substantially planar relationship adjacent a window frame, said curtain-receiving framework being of a size and configuration closely approximating the configuration represented by said array of rod-receiving clips, each of said resilient clips of said array being generally of C-shaped configuration and having an outwardly directed entrance portion of reduced size, enlarging into a portion configured to closely receive and retain a respective portion of a rod of said framework that has been thrust into the clip, said framework, because of its sturdy construction, being of essentially consistent size and thus able to be brought predictably into mating contact with said outwardly directed entrance portion of each of said resilient clips, without occasioning the individual fitting of each respective rod portion onto a particular clip of said clip array, said framework, when installed in said clip array, forming an effective means for supporting the curtain in a desired relationship to the window, said curtain-receiving framework being readily removable from said clips, on occasion, by a relatively simple withdrawal movement, said framework comprising a first rod to be installed in the frame of the window, a short, upstanding member operatively disposed at each end of said first rod, and a second rod usable in an interfitting relationship with said first rod, said second rod having an aperture at least at one end, such that said aperture in said second rod can be installed upon one of said upstanding members disposed at the ends of said first rod, each of said short, upstanding members operatively disposed at the ends of said first rod being adjustably held by mechanical fastening means in a selected angular relationship to said first rod.

* * * * *